US005907287A

United States Patent [19]

Sakagami et al.

[11] Patent Number: 5,907,287

[45] **Date of Patent: *May 25, 1999**

[54] KEYLESS ENTRY CONTROL APPARATUS

[75] Inventors: Atsushi Sakagami, Yokohama; Kenichi Hanada, Isehara, both of Japan

[73] Assignee: Nissan Motor Co., Ltd., Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/629,592

[22] Filed: Apr. 9, 1996

[30] Foreign Application Priority Data

Apr. 11, 1995 [JP] Japan ..... 7-085442

[51] Int. Cl.[6] ..... B06R 25/00; H04K 1/00

[52] U.S. Cl. ..... 340/825.31; 340/825.34; 340/825.69; 340/825.72; 307/10.1; 307/9.1; 324/402; 364/424.037; 364/424.039; 364/425.034; 364/431.11

[58] Field of Search ..... 340/825.31, 825.34, 340/825.69, 825.72, 825.67; 307/10.1, 9.1; 324/402; 364/431.11, 424.037, 424.039, 425.034, 551.01; 361/170, 171

[56] References Cited

U.S. PATENT DOCUMENTS

| | | | |
|---|---|---|---|
| 4,584,487 | 4/1986 | Hesse et al. | 307/10 R |
| 4,837,454 | 6/1989 | Ishii et al. | 307/10.1 |
| 5,146,215 | 9/1992 | Drori | 340/825.32 |
| 5,381,334 | 1/1995 | Furui | 364/424.03 |
| 5,412,379 | 5/1995 | Waraksa et al. | 340/825.72 |
| 5,414,645 | 5/1995 | Hirano | 364/551.01 |
| 5,563,600 | 10/1996 | Miyake | 341/173 |
| 5,760,701 | 6/1998 | Mitsumoto | 340/825.31 |

*Primary Examiner*—Michael Horabik
*Assistant Examiner*—Y. Beaulieu
*Attorney, Agent, or Firm*—McDermott, Will & Emery

[57] ABSTRACT

In a keyless entry control apparatus having a fault diagnosis unit provided separately from a car and a keyless entry C/U, the fault diagnosis unit transmits a signal to each control unit connected to a communication line, and when receiving a communication enabling signal transmitted from the keyless entry C/U, the fault diagnosis unit can communicate with the keyless entry C/U. In the case where ID codes are entered in the keyless entry C/U, a signal for setting the keyless entry C/U to ID entry mode is transmitted from the fault diagnosis unit to the keyless entry C/U. The keyless entry C/U which received the signal is set to ID entry mode, and transmits entry information of the ID codes entered in an EEPROM to the fault diagnosis unit immediately. The entry information is displayed on a display device of the fault diagnosis unit.

17 Claims, 5 Drawing Sheets

FIG.3A

SELECTION MENU

1: FAULT DIAGNOSIS OF ECCS

2: FAULT DIAGNOSIS OF KEYLESS ENTRY C/U

FIG.3B

SELECTION MENU

1: ID ENTRY

2: DATA MONITOR

KEYLESS ENTRY CONTROL APPARATUS

BACKGROUND OF THE INVENTION

1. Field of the Invention

The present invention relates to a keyless entry control apparatus which is capable of locking and unlocking a door by means of an instruction from a transmitter which is remotely controlled, more specifically, a keyless entry control apparatus which is capable of entering ID codes of a transmitter therein.

2. Prior Art

A keyless entry unit, which locks and unlocks a door of a car according to an instruction from a transmitter which is remotely controlled, is known. In such a keyless entry unit, inherent ID codes are allocated respectively to transmitters, and locking and unlocking information and the ID code information are transmitted from the transmitters. Then, on a car side which received the information, a check is made as to whether the received ID codes agree with previously entered ID codes, and only when both the ID codes agree with each other, the door can be locked and unlocked by the transmitter.

In the case where the ID codes of the transmitter are entered to the keyless entry unit, the keyless entry unit is temporarily set to ID-entry-mode, and the ID codes are transmitted from the transmitter. If the procedure for setting to ID-entry-mode is simplified, the keyless entry unit might be set to ID-entry-mode when an operator does not intend to do so. As a result, an effect of preventing a theft is lowered. For this reason, in a conventional method, only when operation members, such as an ignition key, are operated following a determined procedure, the apparatus can be set to ID-entry-mode.

However, in order to improve the effect of preventing a theft, the procedure for setting to ID-entry-mode should be complicated. As a result, time required to enter the ID codes becomes longer, and there is high possibility of a mistake in the operating procedure.

SUMMARY OF THE INVENTION

It is an object of the present invention to provide a keyless entry control apparatus which is capable of easily entering ID codes from a transmitter, which is remotely controlled, without deteriorating an effect of preventing a theft.

In order to achieve the above object, the keyless entry control apparatus of the present invention has a keyless entry unit and a fault diagnosis unit, which is provided separately from a car and which at least diagnoses faults of the keyless entry control unit. The keyless entry unit has ID checking section for checking as to whether ID codes transmitted from a transmitter, which can at least instruct a door to be locked and unlocked, agree with previously entered ID codes, and an ID entry section for, when the ID codes are transmitted from the transmitter after not less than one kind of operating members are operated according to a prescribed operating procedure, entering the ID codes.

The fault diagnosis unit transmits an entry instruction signal, for instructing the keyless entry unit to enter the ID codes, to the keyless entry unit. When the ID entry section receives the entry instruction signal, the ID entry section permits the ID codes transmitted from the transmitter to enter whether the operating members are operated according to the prescribed operating procedure or not.

In accordance with the above arrangement, the fault diagnosis unit provided separately from a car is connected to the keyless entry unit, and the entry instruction signal for instructing the keyless entry unit to enter the ID codes is transmitted from the fault diagnosis unit. When the keyless entry unit receives the signal, the ID entry section enters the ID codes transmitted from the transmitter therein. In other words, in the case where the ID codes are entered, it is not necessary to operate operating members with prescribed procedure like conventional method.

The keyless entry control apparatus is arranged so that the keyless entry unit is connected to a plurality of control units in a car including at least an engine control unit through a communication line and that fault diagnosis unit is connected to a connector, which is mounted to one end of the communication line.

In accordance with the above arrangement, the keyless entry unit is connected to a plurality of the control units in a car through the communication line, and the fault diagnosis unit is connected to the connector mounted to one end of the communication line. In other words, the fault diagnosis unit for diagnosing faults of the plural control units in a car is utilized for ID code entry.

The keyless entry control apparatus is arranged so that the fault diagnosis unit transmits a predetermined signal to the keyless entry unit, and only when the keyless entry unit responds to the signal, the fault diagnosis unit diagnoses faults of the keyless entry unit and permits the ID entry section to enter the ID codes.

In accordance with the above arrangement, prior to the communication with the keyless entry unit, a predetermined signal is transmitted to the keyless entry unit, and only when the keyless entry unit responds to the signal, the keyless entry unit can diagnose faults and the ID entry section can enter ID codes therein. As a result, accuracy of the communication is improved.

The keyless entry control apparatus is arranged so that when receiving the entry instruction signal transmitted from the fault diagnosis unit, the ID entry section transmits entry information about the entered ID codes to the fault diagnosis unit.

In accordance with the above arrangement, when the fault diagnosis unit instructs the keyless entry unit to enter the ID codes, entry information about already entered ID codes is transmitted to the fault diagnosis unit.

The keyless entry control apparatus is arranged so that the fault diagnosis unit has a display device, and when receiving the entry information transmitted from the ID entry section, the fault diagnosis unit displays at least one of the information, about the number of ID codes entered in the ID entry section, the number of ID codes which can be entered, and as to whether the ID codes transmitted from the transmitter have already been entered, on the display device.

In accordance with the above arrangement, the entry information transmitted from the ID entry section is received by the fault diagnosis unit 6 so as to be displayed on the display device. More specifically, at least one of the information, about the number of ID codes entered in the ID entry section, the number of ID codes which can be entered, and as to whether the ID codes transmitted from the transmitter have already been entered, is displayed.

For a fuller understanding of the nature and advantages of the invention, reference should be made to the ensuing detailed description taken in conjunction with the accompanying drawings.

BRIEF DESCRIPTION OF THE DRAWINGS

In the accompanying drawings:

FIGS. 3A and 3B are drawings which show an example of display screen of the fault diagnosis unit.

DESCRIPTION OF THE PREFERRED EMBODIMENTS

The following describes one embodiment of the present invention on referring to FIGS. 1 through 5.

Figure 1:
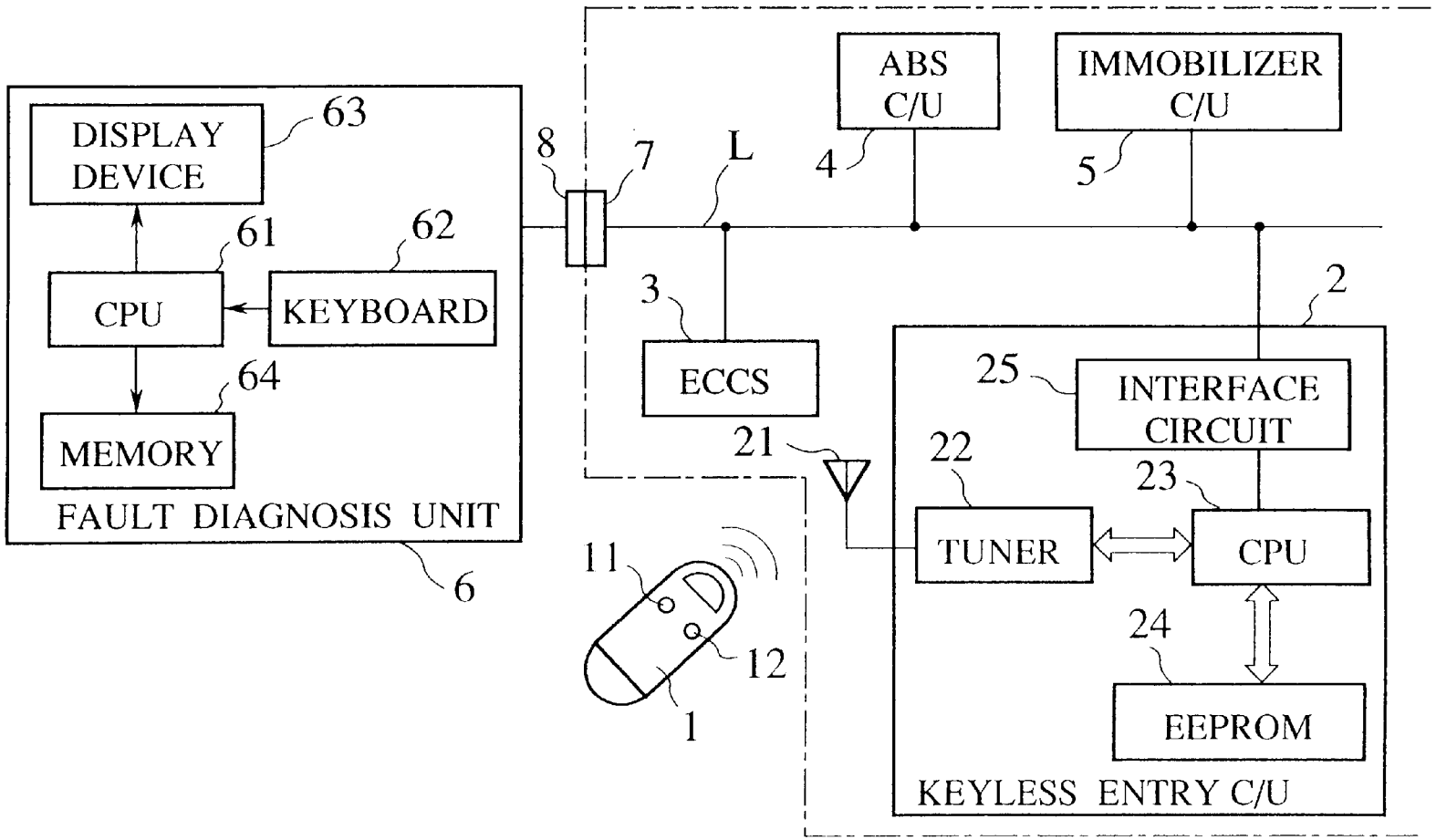
FIG. 1 is a block diagram which shows one embodiment of a keyless entry control apparatus according to the present invention.

FIG. 1 is a block diagram of one embodiment of the keyless entry control apparatus according to the present invention. Reference numeral 1 is a remote control transmitter for transmitting a radio wave to a car, and it is provided with a door locking switch 11 for instructing a door to be locked and a door unlocking switch 12 for instructing a door to be unlocked. Reference numeral 2 is a keyless entry control unit (hereinafter, referred to as a keyless entry C/U) borne by a car, and it is provided with a receiving antenna 21 for receiving a radio wave from the remote control transmitter 1, a tuner 22 for demodulating the received radio wave as ID code information and as locking/unlocking information, a CPU 23 for checking the ID codes transmitted from the remote control transmitter 1 with the previously entered ID codes so as to make a judgment as to locking or unlocking the door, an EEPROM 24 for storing the ID codes of the remote control transmitter 1 therein, and an interface circuit 25 for communicating with each control unit in the car.

A communication line L is connected to the interface circuit 25, and the control units in the car, such as an engine control unit 3 (hereinafter, referred to as ECCS) for controlling an engine, an anti-lock brake system control unit 4 (hereinafter, referred to as ABSC/U) for preventing locking of wheels and an immobilizer control unit 5 (hereinafter, referred to as immobilizer C/U) for making a check on a key, are connected to the communication line L. Moreover, a diagnosis connector 7 for communicating with the fault diagnosis unit 6 outside the car is installed to one end of the communication line L.

The fault diagnosis unit 6 is provided with a CPU 61, a keyboard 62, a display device 63 and a memory 64. The fault diagnosis unit 6 makes a diagnosis on a fault of each control unit connected to the communication line L, and sets the keyless entry C/U 2 to ID-entry-mode. A connector 8, which can be connected to a diagnosis connector 7 of the car, is installed to the fault diagnosis unit 6, and when the connector 8 is connected to the diagnosis connector 7, the fault diagnosis unit 6 can communicate with each control unit in the car.

Figure 2:
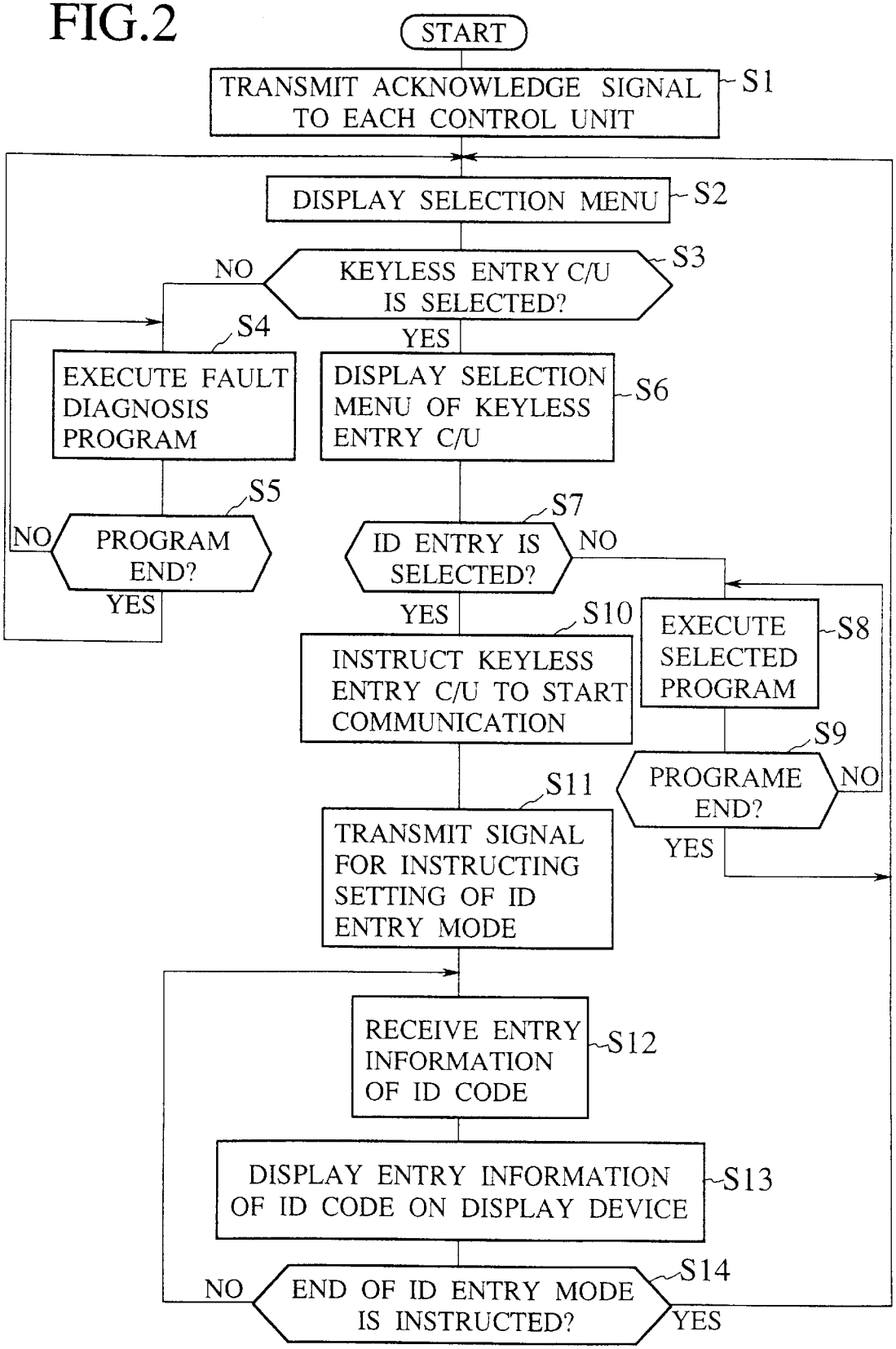
FIG. 2 is a flow chart which shows an operation of a CPU in a fault diagnosis unit.

FIG. 2 is a flow chart which shows an operation of the CPU 61 in the fault diagnosis unit 6. This operation is started by connecting the connector 8 of the fault diagnosis unit 6 to the diagnosis connector 7 and by switching on the fault diagnosis unit 6.

In FIG. 2, at step(S) 1, in order to check as to whether each control unit connected to the communication line L can communicate with the fault diagnosis unit 6, an acknowledge signal is transmitted to each control unit. In the case where the control units can communicate with the fault diagnosis unit 6, the control units, which received the acknowledge signals, transmit communication enabling signals to the fault diagnosis unit 6 through the communication line L. As a result, the fault diagnosis unit 6 recognizes kinds of the control units which can communicate therewith as to fault diagnosis, etc.

At step 2, a list of the communicable control units is displayed on the display device 63 of the fault diagnosis unit 6 so that an operator can make any selection. For example, in the case where the judgment is made at step 1 that the ECCS 3 and the keyless entry C/U 2 can communicate with the fault diagnosis unit 6, a selection menu shown in FIG. 3A is displayed on the display device 63 so that the operator can make a selection.

A judgment is made at step 3 as to whether the control unit selected by the operator is the keyless entry C/U 2. In the case where the judgment is made that it is not the keyless entry C/U 2, the sequence goes to step 4, and a fault diagnosis program corresponding to the control unit selected by the operator is read from the memory 64 so as to be executed. A judgment is made at step 5 as to whether the program executed at step 4 is completed. In the case where the judgment is made that the program is not completed, the sequence returns to step 4, and in the case where the judgment is made that the program is executed, the sequence returns to step 2.

Meanwhile, in the case where the judgment is made at step 3 that the operator selected the keyless entry C/U 2, the sequence goes to step 6, and a selection menu related to the keyless entry C/U 2 is displayed on the display device 63. For example, as shown in FIG. 3B, "1: ID entry" which is a menu for setting the keyless entry C/U 2 to ID-entry-mode, and "2: data monitor" which is a menu for checking for input/output of the keyless entry C/U 2 are displayed.

When one of the items is selected by the operator through the keyboard 62, the sequence goes to step 7, and a judgment is made as to whether the selected menu is "1: ID entry". When the judgment is made that the selected menu is not "1: ID entry", the sequence goes to step 8, and a program, which corresponds to the menu selected by the operator is read out from the memory 64 so as to be executed. A judgment is made at step 9 as to whether the program executed at step 8 is completed. When the judgment is made that the program is not completed, the sequence returns to step 8, and when the judgment is made that the program is completed, the sequence returns to step 2.

Meanwhile, the judgment is made at step 7 that the selected menu is "1: ID entry", the sequence goes to step 10 and a signal, which informs starting of communication, is transmitted to the keyless entry C/U 2. The keyless entry C/U 2 which received the signal stops the keyless controlling process so as to prepare to communicate with the fault diagnosis unit 6.

At step 11, a signal for setting the keyless entry C/U 2 to ID-entry-mode is transmitted. The keyless entry C/U 2 which received the signal enter ID-entry-mode, and transmits information about, for example, the number of ID codes, which are currently entered in the keyless entry C/U 2, to the fault diagnosis unit 6 through the communication line L as mentioned later. When being set to ID-entry-mode, the keyless entry C/U 2 resets all the ID codes entered in the EEPROM 24.

The information about the number of the entered ID codes, etc. transmitted from the keyless entry C/U 2 is received by the fault diagnosis unit 6 at step 12, and is displayed on the display device 63 at the next step 13. More specifically, information about the number of the currently entered ID codes, information about the number of the ID codes which can be entered after that, information about whether the ID codes transmitted from the remote control transmitter 1 have already been entered, etc. is displayed.

A judgment is made at step 14 as to whether the operator instructs the keyless entry C/U 2 to end ID-entry-mode. When the judgment is made that the keyless entry C/U 2 is not instructed to end ID-entry-mode, the sequence returns to step 12, and when the judgment is made that the keyless entry C/U 2 is instructed to end ID-entry-mode, the sequence returns to step 2.

Figure 4:
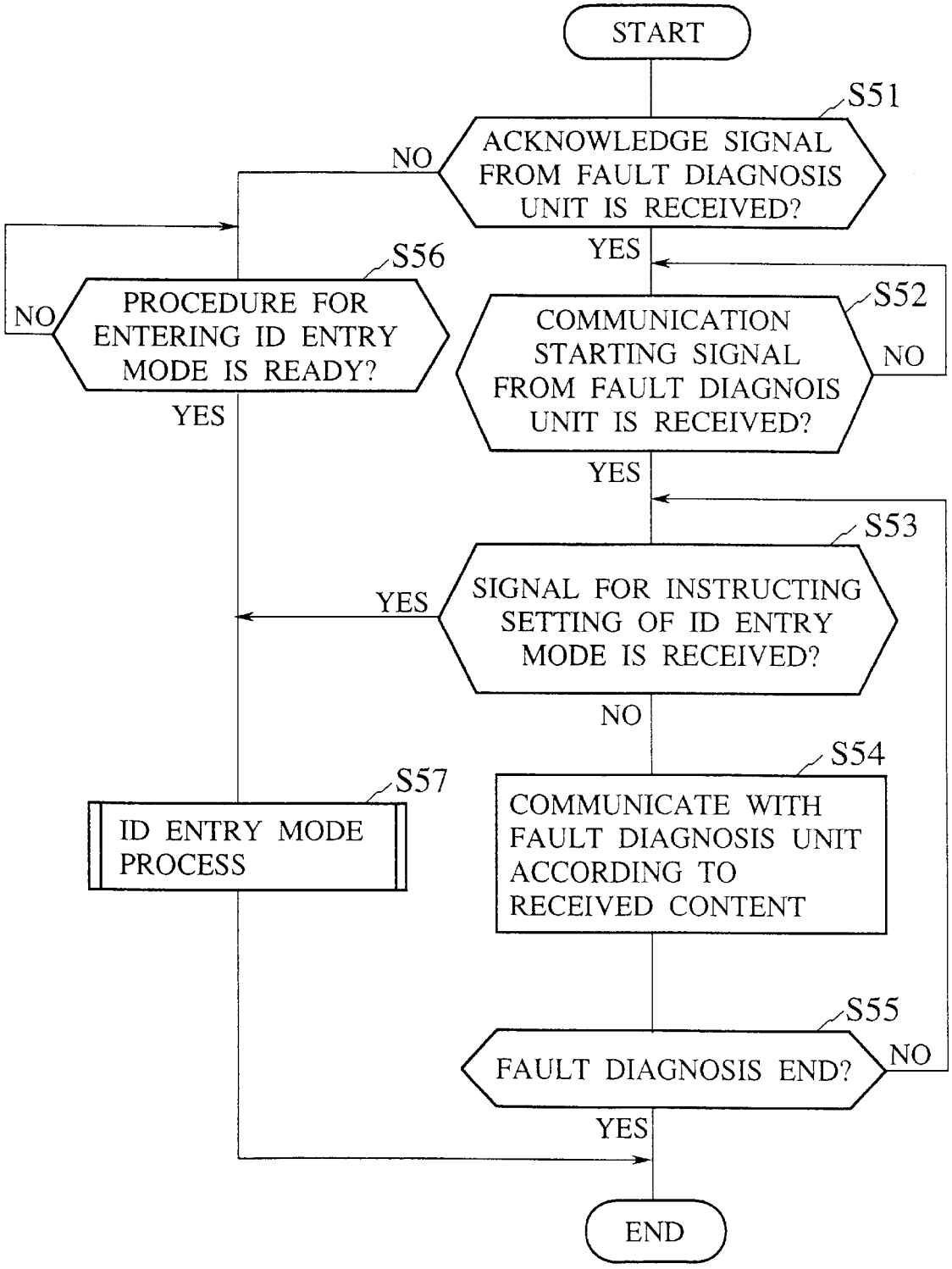
FIG. 4 is a flow chart which shows an operation of a CPU in the keyless entry control unit.

FIG. 4 is a flow chart which shows an operation of the CPU 23 in the keyless entry C/U 2. When the ignition key is moved to an ignition-ON position or an accessory position, the CPU 23 starts the process of the flow chart in FIG. 4.

A judgment is made at step 51 of FIG. 4 as to whether an acknowledge signal transmitted from the fault diagnosis unit 6 is received. When the acknowledge signal is received and the communication with the fault diagnosis unit 6 is prepared, the keyless entry C/U 2 transmits a communication enabling signal to the fault diagnosis unit 6, and the sequence goes to step 52. A judgment is made at step 52 as to whether a signal transmitted from the fault diagnosis unit 6 for instructing the keyless entry C/U 2 to start the communication is received. When the judgment is made that the signal is received, the sequence goes to step 53, and a judgment is made as to whether a signal transmitted from the fault diagnosis unit 6 for setting the keyless entry C/U 2 to ID-entry-mode is received. When the judgment is made that the signal is not received, the sequence goes to step 54, and the keyless entry C/U 2 communicates with the fault diagnosis unit 6 according to the content of the received fault diagnosis signal.

A judgment is made at step 55 as to whether the fault diagnosis by the fault diagnosis unit 6 is completed. In other words, the judgment is made as to whether a signal transmitted from the fault diagnosis unit 6 for instructing the keyless entry C/U 2 to complete the fault diagnosis is received. When the judgment is made that the signal is not received, the sequence returns to step 53, and when the judgment is made that the signal is received, the sequence terminates.

Figure 5:
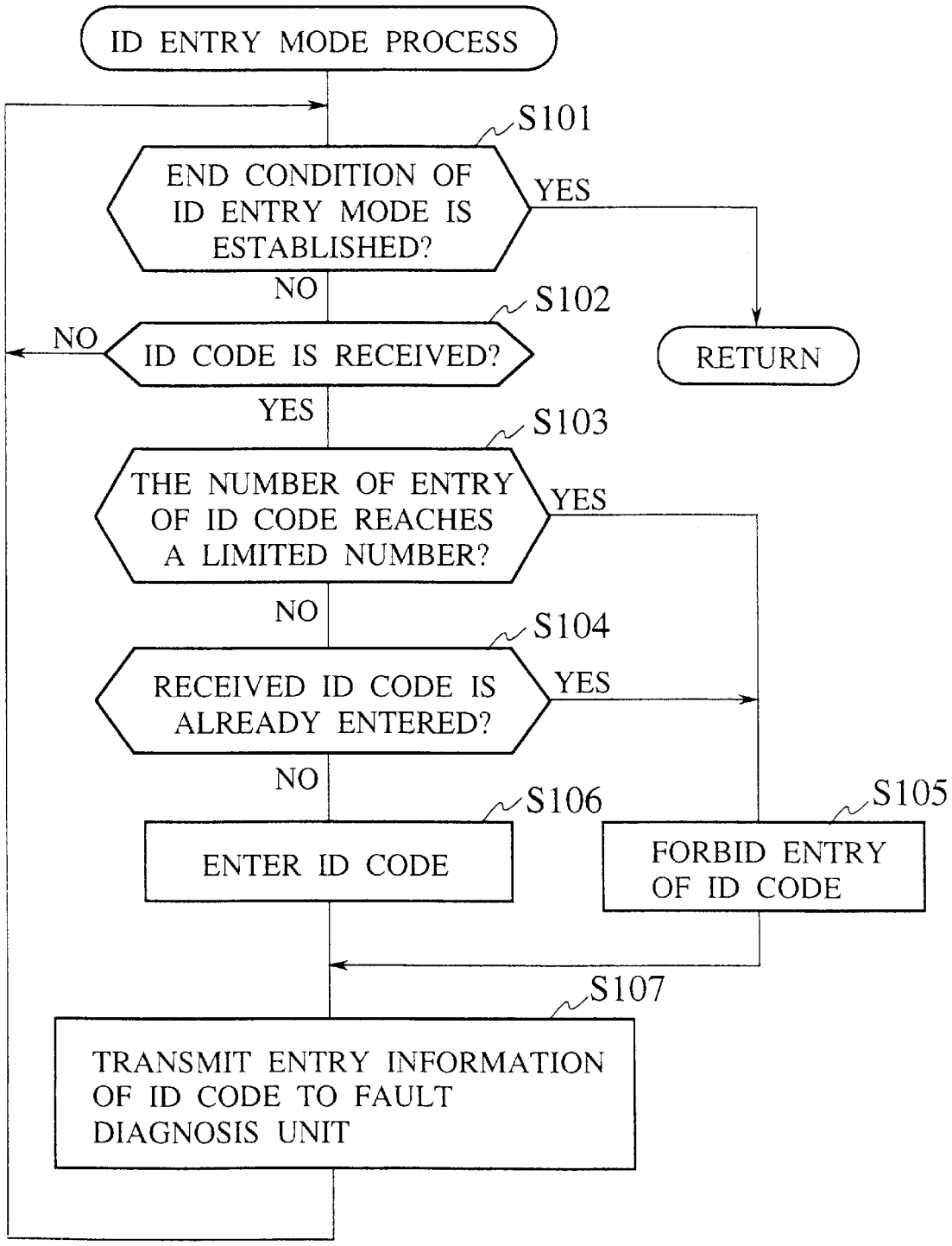
FIG. 5 is a detailed flow chart of the process of ID-entry-mode.

Meanwhile, when the judgment is made at step 53 that the signal for setting the keyless entry C/U 2 to ID-entry-mode is received, the sequence goes to step 57 so that the ID-entry-mode process shown in FIG. 5 in detail is executed, and the sequence terminates. Here, the ID-entry-mode process in FIG. 5 is mentioned later.

Meanwhile, when the judgment is made at step 51 that the acknowledge signal from the fault diagnosis unit 6 is not received, the sequence goes to step 56, and the usual keyless entry control is made. In other words, a judgment is made at step 56 as to whether a procedure for entering ID-entry-mode is prepared, for example, whether the key is inserted and extracted prescribed number of times within prescribed time. When the judgment is made at step 56 that the procedure for entering ID-entry-mode is prepared, the sequence goes to step 57 so that the ID-entry-mode process of FIG. 5 is executed, and then the sequence terminates.

FIG. 5 is a detailed flow chart of the ID-entry-mode process at step 57 in FIG. 4. A judgment is made at step 101 as to whether a condition of end of ID-entry-mode is established. When the judgment is made that the condition is established, the sequence returns to the upper program, and when the judgment is made that the condition is not established, the sequence goes to step 102. A judgment is made at step 102 as to whether the ID code transmitted from the remote control transmitter 1 is received. When the judgment is made that the ID code is not received, the sequence returns to step 101, and when the judgment is made that the ID code is received, the sequence goes to step 103.

A judgment is made at step 103 as to whether the number of entered ID codes reaches a limitation number. When the judgment is made that the number does not reach a limitation number, the sequence goes to step 104 so that a judgment is made as to whether the received ID codes have been already entered. When the judgment is made at step 104 that the ID codes have been already entered, the sequence goes to step 105 so that a process for forbidding the entry of ID codes is executed.

Meanwhile, when the judgment is made at step 104 that the ID codes have not been entered, the sequence goes to step 106 so that a process for entering the ID codes transmitted from the remote control transmitter 1 in the EEPROM 204 is executed.

When the process of S105 or S106 is completed, the sequence goes to step 107 so that the entered information about the ID codes stored in the EEPROM 24 is transmitted to the fault diagnosis unit 6, and the sequence returns to step 101.

The processes of FIGS. 2, 4 and 5 explained above are summarized. Before the fault diagnosis is started, the fault diagnosis unit 6 transmits the acknowledge signals to each control unit through the communication line L, and the responded control units are judged as communicable so as to be displayed on the display device 63. When the operator selects one of the displayed control units on the display device 63, the fault diagnosis program in connection with the selected control unit is read out from the memory 64 so as to be executed.

If the operator selects the keyless entry C/U 2, the selection menu in connection with the keyless entry C/U 2 is displayed on the display device 63. When the operator selects the menu in connection with the setting of ID-entry-mode in this state, the fault diagnosis unit 6 transmits the signal, for setting the keyless entry C/U 2 to ID-entry-mode, to the keyless entry C/U 2. When the keyless entry C/U 2 which received the signal transmits information about the number of entered ID codes, etc., the fault diagnosis unit 6 receives the information so as to display it on the display device 63.

Meanwhile, when the keyless entry C/U 2 receives the signal for starting the communication from the fault diagnosis unit 6, the keyless entry C/U 2 stops the keyless controlling process so as to communicate with the fault diagnosis unit 6. Thereafter, when the signal for setting the keyless entry C/U 2 to ID-entry-mode is received, the ID-entry-mode process is executed. In the ID-entry-mode process, only in the case where the ID code transmitted from the remote control transmitter 1 is not entered in the EEPROM 24 yet and where the EEPROM 24 has a free area, ID codes are entered.

In the present embodiment, as the method for setting the keyless entry C/U 2 to ID-entry-mode, a method using the fault diagnosis unit 6 is additionally applied besides the conventional methods, and thus ID codes can be entered without complicated operating procedures. As a result, time required for entry can be greatly reduced, and a problem, that the keyless entry C/U 2 cannot be set to ID-entry-mode due to an error in the operating procedure, is solved. Therefore, in the case where the entry operation is performed on the production line of a car, ID codes can be quickly entered without disturbing another operations. Moreover, since the fault diagnosis unit 6 is owned only by a car manufacturer, a dealer, etc., even if the procedure for entering ID codes is simplified as described above, an effect of preventing a theft is not lowered.

In the present embodiment, prior to the communication with the keyless entry C/U 2, an acknowledge signal is transmitted to the keyless entry unit, and only when the keyless entry C/U 2 responds to the signal, the keyless entry C/U 2 can diagnose faults and ID codes can be entered EEPROM 24. As a result, the communication between the fault diagnosis unit 6 and the keyless entry C/U 2 may be carried out with high reliability.

Furthermore, in the case where ID codes are entered by using the fault diagnosis unit 6, the information of the ID codes entered in the keyless entry C/U 2 is displayed on the display device 63 of the fault diagnosis unit 6 immediately. As a result, the information as to whether and how many codes are currently entered and how many codes will be able to be entered can be accurately acquired and a check can be immediately made as to whether ID codes transmitted from the remote control transmitter 1 are correctly entered, whereby an error in entry can be prevented.

In addition, in the present embodiment, since ID codes are entered by using the fault diagnosis unit 6, which is originally provided in order to diagnose faults of each control unit in a car, the cost does not rise.

In the present embodiment, a function for selecting as to whether ID codes can be entered by the fault diagnosis unit 6 may be provided to the keyless entry C/U 2 or the fault diagnosis unit 6. For example, ID codes may be entered by the fault diagnosis unit 6 when a car is produced, and thereafter ID codes may be entered only by the conventional operating procedure.

In the embodiment having such an arrangement, the tuner 22, the CPU 23 and the EEPROM 24 correspond to ID checking means, the flow chart of FIG. 5 corresponds to ID entry means, and the keyless entry C/U 2 corresponds to a keyless entry unit.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A keyless entry control apparatus comprising:

a keyless entry unit storing a plurality of ID codes and provided with ID checking means for checking as to whether an ID code transmitted from a transmitter, which instructs a door to be locked and unlocked, agrees with a previously stored ID code, and ID entry means for, when the transmitted ID code is not stored in the keyless entry unit, storing the transmitted ID code therein; and a fault diagnosis unit for at least diagnosing faults of said keyless entry unit, said fault diagnosis unit being provided separately from a car and transmitting an entry instruction signal to the keyless entry unit instructing the keyless entry unit to enter an ID code entry mode, wherein:

said ID entry means permits storing of the transmitted ID code transmitted from the transmitter when the entry instruction signal is received.

2. The keyless entry control apparatus according to claim 1, wherein:

said keyless entry unit is connected to a plurality of control units in a car including at least an engine control unit through a communication line, said fault diagnosis unit is connected to a connector, which is mounted to one end of the communication line.

3. The keyless entry control apparatus according to claim 1, wherein:

said fault diagnosis unit transmits a predetermined signal to said keyless entry unit, and said fault diagnosis unit diagnoses faults of said keyless entry unit and transmits the entry instruction signal only when said keyless entry unit responds to the predetermined signal.

4. The keyless entry control apparatus according to claim 1, wherein:

when the entry instruction signal transmitted from said fault diagnosis unit is received by said keyless entry unit, said ID entry means transmits entry information about the plurality of ID codes currently stored to said fault diagnosis unit.

5. The keyless entry control apparatus according to claim 4, wherein:

said fault diagnosis unit includes a display device, and when receiving the entry information transmitted from said ID entry means, said fault diagnosis unit displays at least one of the information, about the number of ID codes already entered in said ID entry means, the number of ID codes which can be entered, and as to whether the ID code transmitted from the transmitter is currently stored, on the display device.

6. The keyless entry control apparatus according to claim 1, wherein said keyless entry unit includes storage for said plurality of ID codes;

said ID checking means further checks whether a number of ID codes in said storage exceeds a predetermined number; and when said ID checking means determines either that the transmitted ID code agrees with a previously stored ID code or that the number of ID codes in said storage exceeds the predetermined number, said keyless entry unit prohibits entry of the transmitted ID code.

7. The keyless entry control apparatus according to claim 6, wherein:

said keyless entry unit is connected by a communication line to a plurality of control units in a car, including at least an engine control unit;

said fault diagnosis unit is connected to the communication line via a connector, and said fault diagnosis unit diagnoses faults of any of said plurality of control units when connected to said communication line via said connector.

8. The keyless entry control apparatus according to claim 1, wherein:

said transmitter has at least one operating member, and transmits said ID code when said at least one operating member is operated according to a prescribed operating procedure; and said ID entry means permits the ID code transmitted from the transmitter to be stored when said at least one operating member is operated according to the prescribed operating procedure.

9. A keyless entry control system, comprising:

a transmitter for transmitting an ID code peculiar thereto;

a receiver for receiving said ID code transmitted by said transmitter;

a memory for storing at least one ID code;

a door lock controller connected to both said receiver and said memory, said door lock controller locking and unlocking a door when said ID code received by the receiver is identical with the stored at least one ID code; and an ID code entry controller detachably connected to said door lock controller, said ID code entry controller transmitting an instruction signal when said ID code entry controller is connected to said door lock controller, said door lock controller storing a new ID code transmitted from said transmitter in said memory in response to receiving said instruction signal from said ID code entry controller.

10. The keyless entry control system according to claim 9, wherein said ID code entry controller is combined with a diagnosis unit for a vehicle.

11. The keyless entry control system according to claim 10, wherein said door lock controller responds to said instruction signal from said ID code entry controller and makes a determination as to whether the transmitted new ID code is currently stored in said memory and prohibits storing of the transmitted new ID code upon making a determination that the transmitted new ID code is currently stored in said memory.

12. The keyless entry control system according to claim 11, wherein said door lock controller further responds to said instruction signal from said ID code entry controller and makes a determination as to a number of ID codes currently stored in said memory and prohibits storing of the transmitted new ID code upon making a determination that the number of ID codes currently stored in said memory exceeds a predetermined number.

13. The keyless entry control system according to claim 10, wherein said door lock controller responds to said instruction signal from said ID code entry controller and makes a determination as to a number of ID codes currently stored in said memory and prohibits storing of the transmitted new ID codes upon making a determination that the number of ID codes stored in said memory exceeds a predetermined number.

14. A method for controlling keyless entry, comprising the steps of:

transmitting an ID code peculiar to a transmitter to a receiver;

receiving said ID code transmitted by said transmitter;

comparing said ID code received by said receiver with a stored ID code;

controlling locking or unlocking of a door by a door lock controller when said received ID code is identical to the stored ID code;

transmitting an instruction signal from a diagnosis unit when said diagnosis unit is connected to said door lock controller instructing said door lock controller to enter a mode for storing a new ID code transmitted by said transmitter; and storing the transmitted new ID code in said door lock controller when said door lock controller receives said instruction signal from said diagnosis unit.

15. A method for controlling keyless entry in accordance with claim 14, wherein said step of storing comprises the steps of determining whether the transmitted new ID code is currently stored in said door lock controller and prohibiting storing of the transmitted new ID code upon determining that the transmitted new ID code is currently stored.

16. A method for controlling keyless entry in accordance with claim 14, wherein said step of storing comprises the steps of determining a number of ID codes currently stored in said door lock controller and prohibiting storing of the transmitted new ID code upon determining that the number of stored ID codes exceeds a predetermined number.

17. A method for controlling keyless entry in accordance with claim 16, further comprising the steps of determining whether the transmitted new ID code is currently stored in said door lock controller and prohibiting storing of the transmitted new ID code upon determining that the transmitted new ID code is currently stored in said door lock controller.

* * * * *